US011004640B2

(12) United States Patent
Minowa et al.

(10) Patent No.: US 11,004,640 B2
(45) Date of Patent: May 11, 2021

(54) RELAY

(71) Applicant: Omron Corporation, Kyoto (JP)

(72) Inventors: Ryota Minowa, Kumamoto (JP); Hiroyuki Iwasaka, Kumamoto (JP); Yasuo Hayashida, Kumamoto (JP)

(73) Assignee: Omron Corporation, Kyoto (JP)

( * ) Notice: Subject to any disclaimer, the term of this patent is extended or adjusted under 35 U.S.C. 154(b) by 127 days.

(21) Appl. No.: 16/282,348

(22) Filed: Feb. 22, 2019

(65) Prior Publication Data

US 2019/0304725 A1 Oct. 3, 2019

(30) Foreign Application Priority Data

Mar. 30, 2018 (JP) ..... JP2018-068871

(51) Int. Cl.
*H01H 50/44* (2006.01)
*H01H 50/02* (2006.01)
(Continued)

(52) U.S. Cl.
CPC ..... *H01H 50/44* (2013.01); *H01H 50/02* (2013.01); *H01H 50/18* (2013.01); *H01H 50/36* (2013.01); *H01H 50/54* (2013.01); *H01H 50/641* (2013.01)

(58) Field of Classification Search
CPC ..... H01H 50/02; H01H 50/18; H01H 50/36; H01H 50/44; H01H 50/54; H01H 50/641;
(Continued)

(56) References Cited

U.S. PATENT DOCUMENTS 4,467,301 A * 8/1984 Goodrich ..... H01H 1/54 335/195
6,700,466 B1 * 3/2004 Yamamoto ..... H01H 9/443 335/132
(Continued)

FOREIGN PATENT DOCUMENTS

CN 102290286 A 12/2011
CN 105229769 A 1/2016
(Continued)

OTHER PUBLICATIONS

Office Action issued in Chinese Application No. 201910109748.8; dated Oct. 12, 2020 (16 pages).

*Primary Examiner* — Bernard Rojas
(74) *Attorney, Agent, or Firm* — Osha Bergman Watanabe & Burton LLP

(57) ABSTRACT

A relay has a case, a first fixed terminal including a first fixed contact, a second fixed terminal including a second fixed contact, a movable touch piece including a first movable contact that is disposed facing the first fixed contact and a second movable contact that is disposed facing the second fixed contact, the movable touch piece being disposed in the case and disposed so as to be movable in a direction in which the first movable contact and the second movable contact come into contact with the first fixed contact and the second fixed contact and in a direction in which the first movable contact and the second movable contact separate from the first fixed contact and the second fixed contact, a drive shaft connected to the movable touch piece and extending in a movement direction of the movable touch piece, and a coil.

20 Claims, 15 Drawing Sheets

(51) Int. Cl.
*H01H 50/64* (2006.01)
*H01H 50/54* (2006.01)
*H01H 50/36* (2006.01)
*H01H 50/18* (2006.01)

(58) Field of Classification Search
CPC .... H01H 50/045; H01H 50/14; H01H 50/443; H01H 50/42
USPC ..... 335/16, 126, 131, 147, 195
See application file for complete search history.

(56) References Cited

U.S. PATENT DOCUMENTS 8,138,872 B2 * 3/2012 Yoshihara ..... H01H 51/2209 335/281
8,841,979 B2 * 9/2014 Uchida ..... H01H 50/546 335/195
2011/0304947 A1 12/2011 Niimi et al.
2013/0021122 A1 * 1/2013 Uchida ..... H01H 1/54 335/131
2013/0321106 A1 12/2013 Niimi et al.
2014/0285040 A1 9/2014 Niimi et al.
2016/0071675 A1 3/2016 Haehnel et al.
2018/0009399 A1 * 1/2018 Pal ..... H02B 1/052
2019/0066956 A1 * 2/2019 Konishi ..... H01H 1/58
2019/0304724 A1 * 10/2019 Minowa ..... H01H 1/62

FOREIGN PATENT DOCUMENTS

JP 2010-010059 A 1/2010
JP 2010170793 A 8/2010
JP 2012174519 A 9/2012

* cited by examiner

RELAY

CROSS-REFERENCE TO RELATED APPLICATION

This application claims priority to Japanese Patent Application No. 2018-068871 filed with the Japan Patent Office on Mar. 30, 2018, the entire contents of which are incorporated herein by reference.

BACKGROUND

Field

The present invention relates to a relay.

Related Art

A relay is provided with a movable touch piece including a movable contact, a fixed terminal including a fixed contact, and a coil. The coil generates a driving force for operating the movable touch piece. The movable touch piece operates and the movable contact comes in contact with or separates from the fixed contact so that the contacts are opened and closed.

The relay is provided with a coil connection for supplying electric power to the coil. The coil connection includes a coil terminal connected to the coil and a connector configured to support the coil terminal. For example, in Japanese Unexamined Patent Publication No. 2010-10059, a connector is disposed on the side surface of a cover of a relay.

SUMMARY

As disclosed in Japanese Unexamined Patent Publication No. 2010-10059, in order to easily connect a coil driving cable from an external circuit to the coil connection, the coil connection is disposed on the outer surface of the case of the relay. Therefore, there is a possibility that the size of the relay may increase due to the coil connection.

One or more embodiments of the present invention prevents an increase in size in the relay in which a coil connection is provided on the outer surface of a case.

A relay according to one aspect includes a case, a first fixed terminal, a second fixed terminal, a movable touch piece, a drive shaft, a drive device, and a coil connection. The first fixed terminal includes a first fixed contact. The second fixed terminal includes a second fixed contact. The movable touch piece includes a first movable contact and a second movable contact. The first movable contact is disposed facing the first fixed contact. The second movable contact is disposed facing the second fixed contact. The movable touch piece is disposed in the case. The movable touch piece is disposed so as to be movable in a direction in which the first movable contact and the second movable contact come into contact with the first fixed contact and the second fixed contact and in a direction in which the first movable contact and the second movable contact separate from the first fixed contact and the second fixed contact. The drive shaft is connected to the movable touch piece and extends in the movement direction of the movable touch piece.

The drive device includes a coil, an iron core, and a yoke. The coil generates a driving force for operating the drive shaft. The iron core is inserted in the coil. The yoke is connected to the iron core. The drive device is disposed in the movement direction of the movable touch piece with respect to the movable touch piece. The coil connection includes a coil terminal connected to the coil and a connector configured to support the coil terminal. The coil connection is provided on the outer surface of the case.

The first fixed terminal includes a first fixed touch piece and a first bus bar. The first fixed touch piece supports the first fixed contact. The first bus bar is connected to the first fixed touch piece. At least a part of the first bus bar is disposed outside the case. The first bus bar includes a portion not overlapping with the drive device as viewed in the movement direction of the movable touch piece. At least a part of the coil connection is disposed so as to overlap with a portion of the first bus bar not overlapping with the drive device as viewed in the movement direction of the movable touch piece.

In the relay according to the present aspect, at least a part of the coil connection is disposed so as to overlap with a portion of the first bus bar not overlapping with the drive device as viewed in the movement direction of the movable touch piece. It is thus possible to dispose the coil connection in a space which becomes a dead space in the relay. This can prevent an increase in size of the relay.

The first bus bar may include a first extension extending in a first direction from the first movable contact to the second movable contact. At least a part of the coil connection may be disposed in a position overlapping with the first extension as viewed in the movement direction of the movable touch piece. In this instance, it is possible to dispose the coil connection in a space which becomes a dead space in the relay. This can prevent an increase in size of the relay.

The first fixed terminal may include a first contact support, a first extension, and a first intermediate portion. The first contact support may be included in the first fixed touch piece and disposed in the case. The first extension may be included in the first bus bar and may extend in a first direction from the first movable contact to the second movable contact. The first intermediate portion may include a shape folded back from the first contact support toward the first extension. At least a part of the coil connection may be disposed in a position overlapping with the first intermediate portion as viewed in the movement direction of the movable touch piece. In this instance, it is possible to dispose the coil connection in a space which becomes a dead space in the relay. This can prevent an increase in size of the relay.

The first bus bar may include a first external connection disposed outside the case. At least a part of the coil connection may be disposed in a position overlapping with the first external connection as viewed in the movement direction of the movable touch piece. In this instance, it is possible to dispose the coil connection in a space which becomes a dead space in the relay. This can prevent an increase in size of the relay.

The first external connection may include a connection structure connected to an external circuit. The coil connection may be disposed in a position not overlapping with the connection structure. In this instance, when the connection structure is connected to the external circuit, it is possible to prevent interference of the coil connection.

The connector may be disposed facing a direction away from the first bus bar. In this instance, it is possible to easily connect to the connector without being hindered by the first bus bar.

The case may include a side surface extending along the movement direction of the movable touch piece. The coil connection may be disposed facing the side surface. In this instance, the size of the relay can be reduced as compared with a configuration where the coil connection is provided on the top surface or the bottom surface of the case.

The case may include a top surface disposed in the movement direction of the movable touch piece with respect to the drive device. The coil connection may be disposed in a position not overlapping with the top surface as viewed in the movement direction of the movable touch piece. In this instance, it is possible to reduce the size of the relay in the movement direction of the movable touch piece.

The first bus bar may have a flat plate shape. The first bus bar may be disposed such that a normal direction of the first bus bar faces the movement direction of the movable touch piece. In this instance, a dead space tends to be generated in a position facing the first bus bar in the movement direction of the movable touch piece. Thus, disposing the coil connection in the space which becomes the dead space enables prevention of an increase in size of the relay.

The first bus bar may include a portion not overlapping with the yoke as viewed in the movement direction of the movable touch piece. At least a part of the coil connection may be disposed so as to overlap with a portion of the first bus bar not overlapping with the yoke as viewed in the movement direction of the movable touch piece. In this instance, it is possible to dispose the coil connection in a space which becomes a dead space in the relay. This can prevent an increase in size of the relay.

According to one or more embodiments of the present invention, it is possible to prevent an increase in relay size in a relay in which the coil connection is provided on the outer surface of the case.

DETAILED DESCRIPTION

Figure 1:
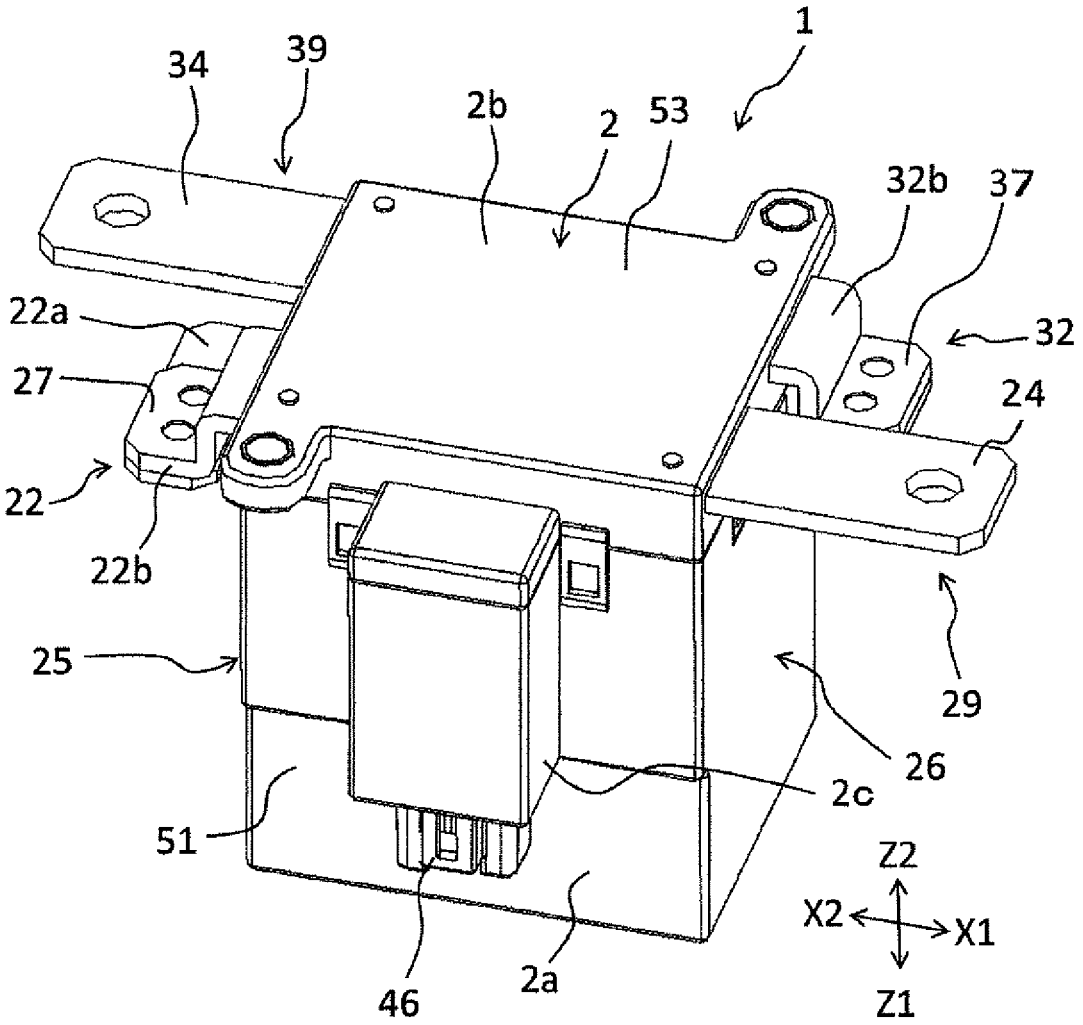
FIG. 1 is a perspective view of a relay according to an embodiment.
Figure 2:
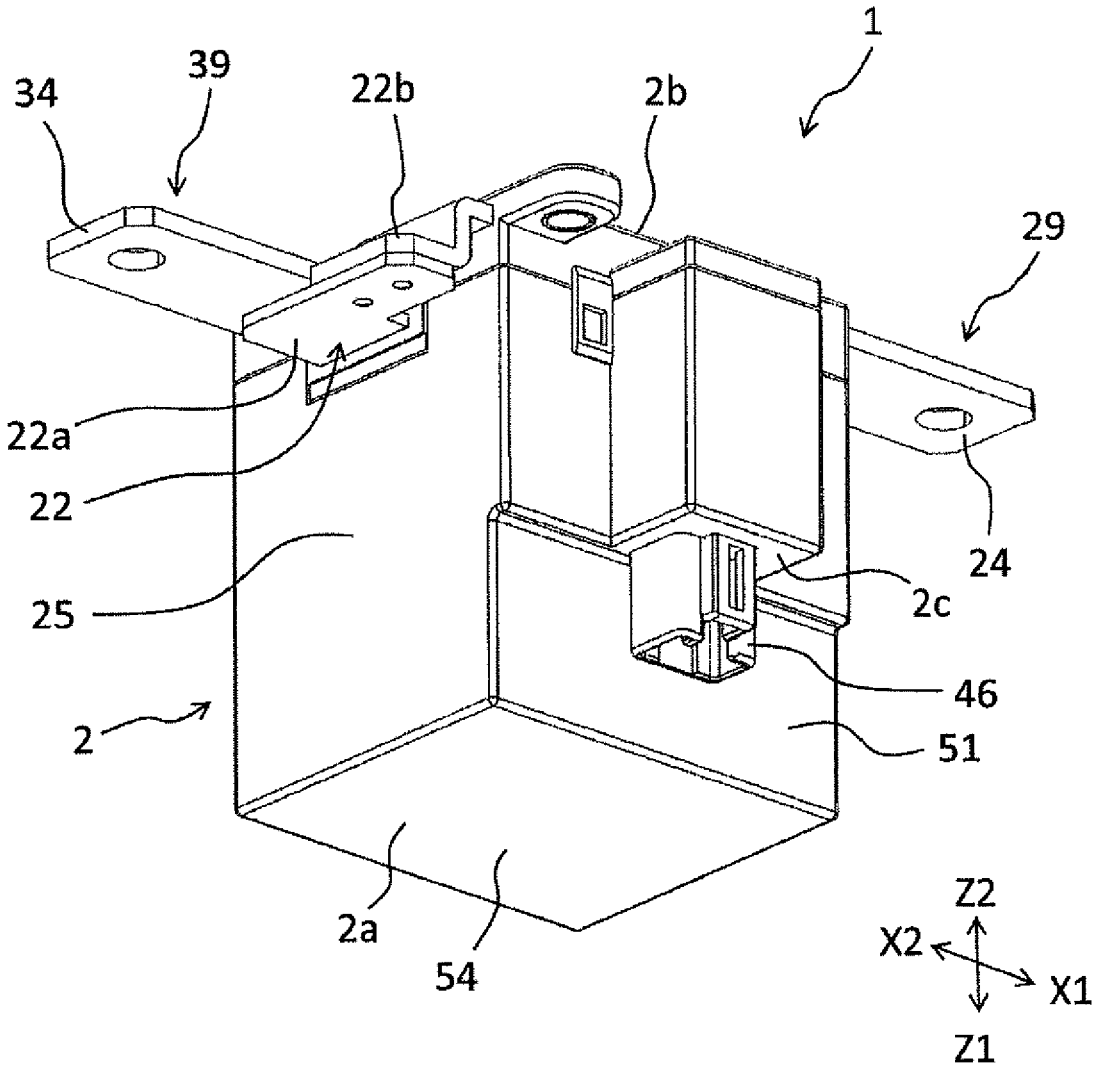
FIG. 2 is a perspective view of the relay.
Figure 3:
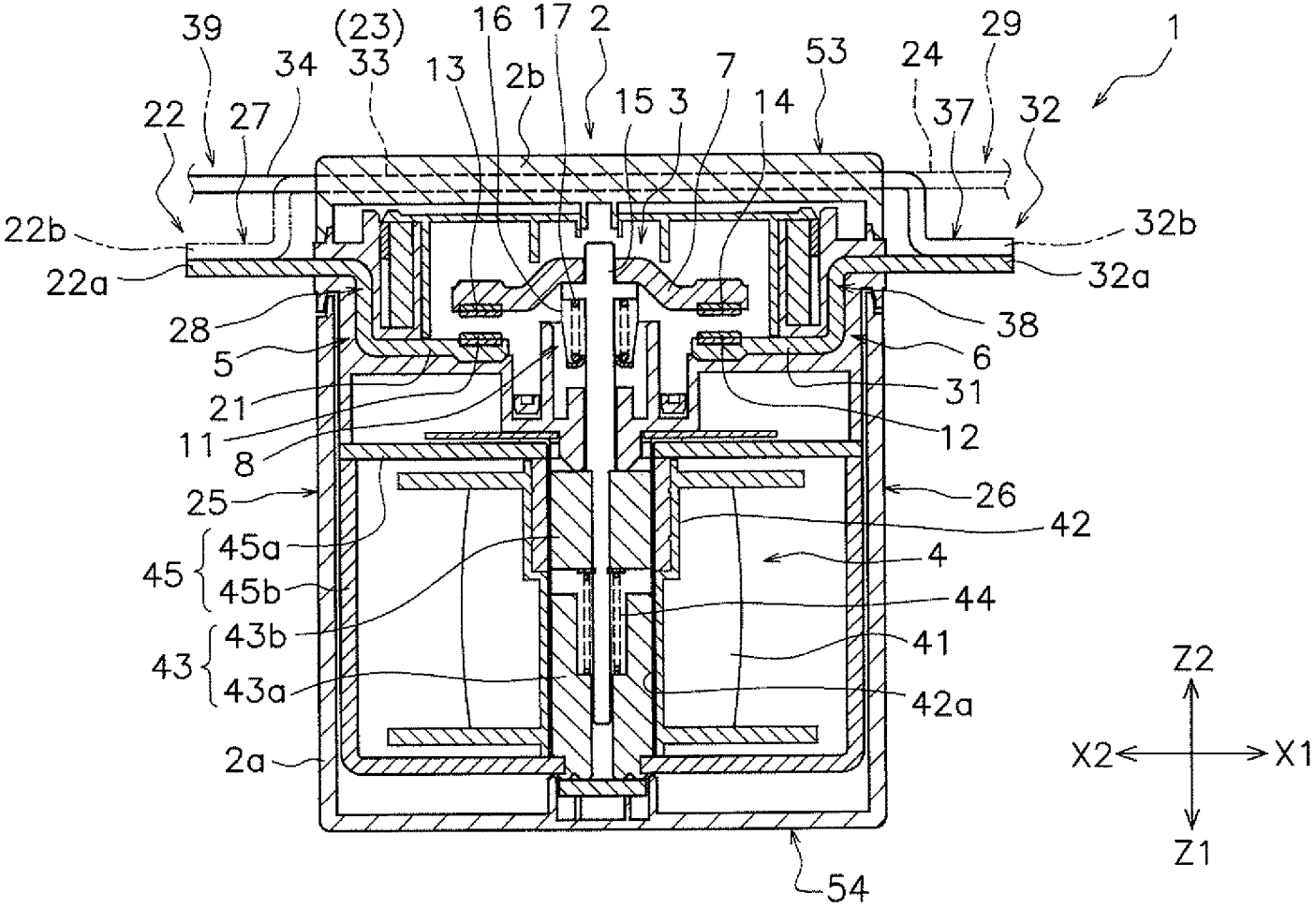
FIG. 3 is a sectional view of the relay.
Figure 4:
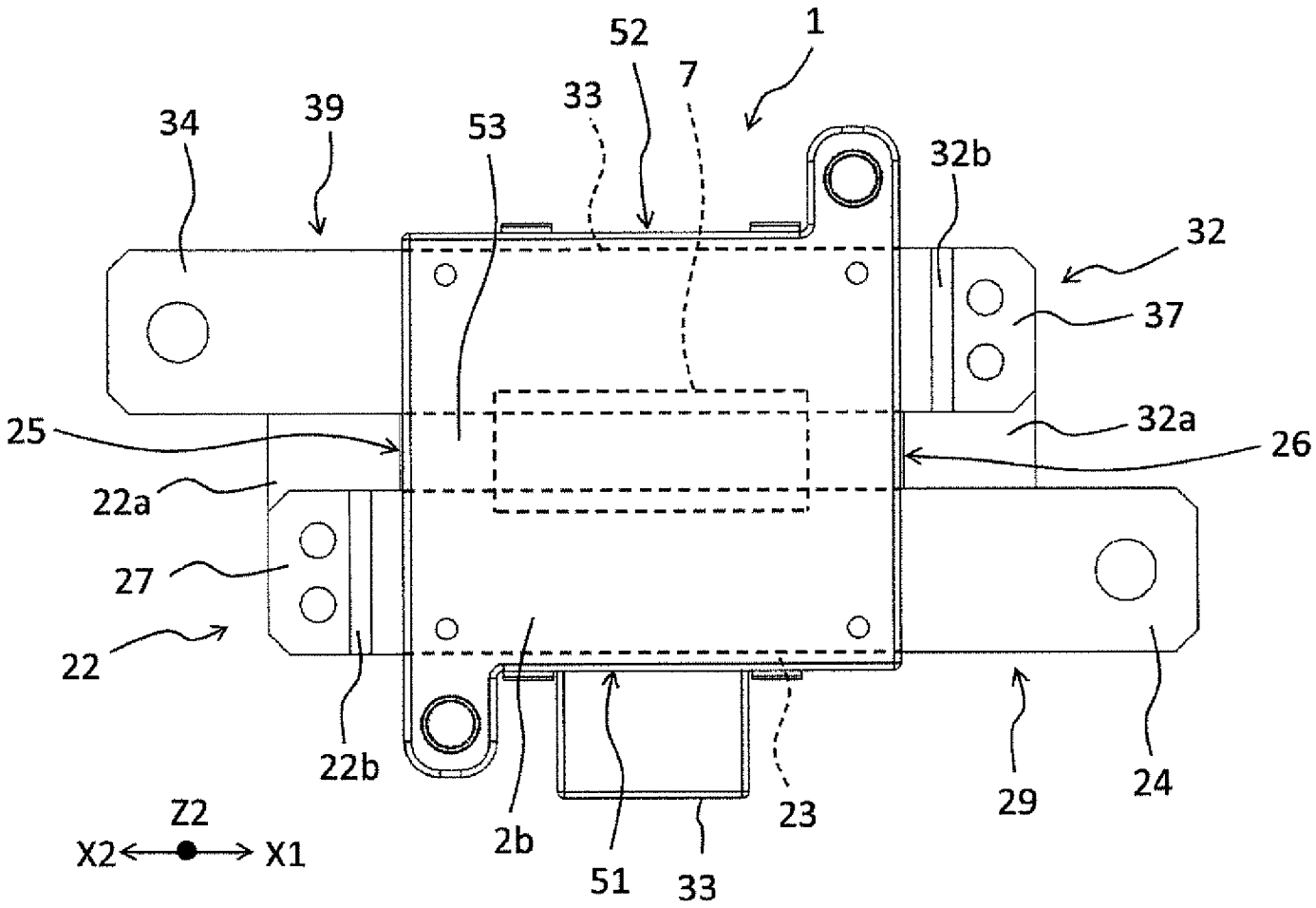
FIG. 4 is a plan view of the relay.

Hereinafter, embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. FIGS. 1 and 2 are perspective views illustrating the relay 1 according to the embodiment. FIG. 3 is a sectional view of the relay 1. As illustrated in FIG. 3, the relay 1 includes a case 2, a contact device 3, and a drive device 4.

The case 2 accommodates the contact device 3 and the drive device 4. The case 2 is formed of a resin having insulation. The case 2 includes a case body 2*a* and a lid portion 2*b*. The contact device 3 and the drive device 4 are disposed in the case body 2*a*. The lid portion 2*b* is separate from the case body 2*a*. The lid portion 2*b* is attached to the case body 2*a*.

The contact device 3 includes a first fixed terminal 5, a second fixed terminal 6, a movable touch piece 7, and a touch piece holding portion 8. The first fixed terminal 5, the second fixed terminal 6, and the movable touch piece 7 are formed of a material having conductivity. The first fixed terminal 5 includes a first fixed contact 11. The second fixed terminal 6 includes a second fixed contact 12. The first fixed contact 11 and the second fixed contact 12 are disposed apart from each other in a longitudinal direction of the movable touch piece 7 (a right-left direction in FIG. 3).

The movable touch piece 7 includes a first movable contact 13 and a second movable contact 14. The first movable contact 13 is disposed facing the first fixed contact 11. The second movable contact 14 is disposed facing the second fixed contact 12. The movable touch piece 7 is disposed movably in a contact direction (Z1) and a separation direction (Z2).

The contact direction (Z1) is a direction (downward in FIG. 3) in which the first movable contact 13 and the second movable contact 14 come into contact with the first fixed contact 11 and the second fixed contact 12. The separation direction (Z2) is a direction (upward in FIG. 3) in which the first movable contact 13 and the second movable contact 14 separate from the first fixed contact 11 and the second fixed contact 12. In the following description, a direction from the first movable contact 13 to the second movable contact 14 (the right side in FIG. 3) is referred to as a "first direction (X1)." Further, a direction from the second movable contact 14 to the first movable contact 13 (leftward in FIG. 3) is referred to as a "second direction (X2)."

The touch piece holding portion 8 holds the movable touch piece 7. The touch piece holding portion 8 includes a drive shaft 15, a holder 16, and a contact spring 17. The drive shaft 15 extends in a movement direction (Z1, Z2) of the movable touch piece 7. The drive shaft 15 is disposed movably in the contact direction (Z1) and the separation direction (Z2). The holder 16 is connected to the movable touch piece 7 and holds the movable touch piece 7. The contact spring 17 is disposed between the drive shaft 15 and the holder 16.

The first fixed terminal 5 includes a first contact support 21, a first intermediate portion 22, a first extension 23, and a first external connection 24. The first contact support 21 supports the first fixed contact 11. The first contact support 21 extends in the second direction (X2) from the first fixed contact 11 in the case 2.

The first intermediate portion 22 connects the first contact support 21 and the first extension 23. At least a part of the first intermediate portion 22 is disposed so as to be exposed to the outside of the case 2. The case 2 includes a first outer side surface 25 and a second outer side surface 26. The first outer side surface 25 and the second outer side surface 26 are disposed as spaced from each other in the first direction (X1)

and the second direction (X2). The first outer side surface 25 and the second outer side surface 26 extend in the movement direction (Z1, Z2) of the movable touch piece 7. The first outer side surface 25 and the second outer side surface 26 are disposed along a lateral direction of the movable touch piece 7. The first intermediate portion 22 protrudes in the second direction (X2) from the first outer side surface 25 of the case 2. That is, the first intermediate portion 22 is exposed to the outside from the first outer side surface 25 of the case 2.

The first intermediate portion 22 has a shape folded from the first contact support 21 toward the first extension 23. The first intermediate portion 22 includes a first flat surface 27. The first flat surface 27 is disposed so as to be exposed to the outside of the case 2. The first flat surface 27 is disposed parallel to the first external connection 24. The first flat surface 27 extends in the second direction (X2) from the first outer side surface 25 of the case 2.

The first extension 23 is disposed apart from the movable touch piece 7 in the separation direction (Z2). The first extension 23 has a flat plate shape. The first extension 23 extends in the first direction (X1). The first extension 23 extends in the first direction (X1) from the first intermediate portion 22 to a position beyond the first fixed contact 11 and the second fixed contact 12. The first extension 23 extends over the entire width of the case 2 in the first direction (X1).

The first external connection 24 is connected to the first extension 23 and protrudes from the second outer side surface 26 of the case 2 in the first direction (X1). The first external connection 24 is a portion to be connected to an external circuit to which the relay 1 is attached. The first external connection 24 is formed integrally with the first extension 23. However, the first external connection 24 may be separate from the first extension 23. The first external connection 24 has a flat plate shape.

In the present embodiment, the first fixed terminal 5 includes a first fixed touch piece 28 and a first bus bar 29. The first bus bar 29 and the first fixed touch piece 28 are separate from each other. The first bus bar 29 has a flat plate shape. The first bus bar 29 is disposed such that a normal direction of the first bus bar 29 faces the movement direction (Z1, Z2) of the movable touch piece 7. The first bus bar 29 is connected to the first fixed touch piece 28. The first fixed touch piece 28 extends in the second direction (X2) from the first fixed contact 11. An end portion of the first fixed touch piece 28 protrudes outward of the case 2. The end portion of the first fixed touch piece 28 is connected to the first bus bar 29 outside the case 2.

The first fixed touch piece 28 is connected to the first bus bar 29 by welding, for example. However, the first fixed touch piece 28 may be connected to the first bus bar 29 by another fixing method. For example, the first fixed touch piece 28 may be connected to the first bus bar 29 by screws. Alternatively, the first fixed touch piece 28 may be formed integrally with the first bus bar 29.

The first fixed touch piece 28 includes the first contact support 21 described above. The first bus bar 29 includes the first extension 23 and the first external connection 24 described above. The first intermediate portion 22 includes a first attachment portion 22*a* included in the first fixed touch piece 28 and a second attachment portion 22*b* included in the first bus bar 29. The first attachment portion 22*a* is formed integrally with the first contact support 21 in the first fixed touch piece 28. The second attachment portion 22*b* is formed integrally with the first extension 23 in the first bus bar 29. However, the first attachment portion 22*a* may be separate from the first contact support 21. The second attachment portion 22*b* may be separate from the first extension 23. The first attachment portion 22*a* and the second attachment portion 22*b* are disposed so as to be exposed to the outside of the case 2.

As illustrated in FIG. 2, the first attachment portion 22*a* has a shape bent toward the first bus bar 29. The second attachment portion 22*b* has a shape bent from the first attachment portion 22*a* toward the first extension 23. The second attachment portion 22*b* is connected to the first attachment portion 22*a*. For example, the second attachment portion 22*b* is connected to the first attachment portion 22*a* by welding. However, the second attachment portion 22*b* may be connected to the first attachment portion 22*a* by another fixing method. For example, the second attachment portion 22*b* may be connected to the first attachment portion 22*a* by screws.

The second fixed terminal 6 has a shape symmetrical with the first fixed terminal 5. The second fixed terminal 6 includes a second contact support 31, a second intermediate portion 32, a second extension 33, and a second external connection 34. The second contact support 31 supports the second fixed contact 12. The second contact support 31 extends in the first direction (X1) from the second fixed contact 12 in the case 2.

The second intermediate portion 32 connects the second contact support 31 and the second extension 33. At least a part of the second intermediate portion 32 is disposed so as to be exposed to the outside of the case 2. The second intermediate portion 32 protrudes in the first direction (X1) from the second outer side surface 26 of the case 2. That is, the second intermediate portion 32 is exposed to the outside from the second outer side surface 26 of the case 2.

The second intermediate portion 32 has a shape folded back from the second contact support 31 toward the second extension 33. The second intermediate portion 32 includes a second flat surface 37. The second flat surface 37 is disposed so as to be exposed to the outside of the case 2. The second flat surface 37 is disposed parallel to the second external connection 34. The second flat surface 37 extends in the first direction (X1) from the second outer side surface 26 of the case 2.

The second extension 33 is disposed apart from the movable touch piece 7 in the separation direction (Z2). The second extension 33 has a flat plate shape. The second extension 33 extends in the second direction (X2). The second extension 33 extends in a second direction (X2) from the second intermediate portion 32 to a position beyond the second fixed contact 12 and the first fixed contact 11. The second extension 33 extends over the entire width of the case 2 in the second direction (X2).

The second external connection 34 is connected to the second extension 33 and protrudes in the second direction (X2) from the first outer side surface 25 of the case 2. The second external connection 34 is a portion connected to the external circuit. The second external connection 34 is formed integrally with the second extension 33. However, the second external connection 34 may be separate from the second extension 33. The second external connection 34 has a flat plate shape.

In the present embodiment, the second fixed terminal 6 includes a second fixed touch piece 38 and a second bus bar 39. The second bus bar 39 is separate from the second fixed touch piece 38. The second bus bar 39 has a flat plate shape. The second bus bar 39 is disposed such that a normal direction of the second bus bar 39 faces the movement direction (Z1, Z2) of the movable touch piece 7. The second bus bar 39 is connected to the second fixed touch piece 38. The second fixed touch piece 38 extends in the first direction (X1) from the second fixed contact 12. An end portion of the second fixed touch piece 38 protrudes outward of the case 2. The end portion of the second fixed touch piece 38 is connected to the second bus bar 39 outside the case 2.

The second fixed touch piece 38 is connected to the second bus bar 39 by welding, for example. However, the second fixed touch piece 38 may be connected to the second bus bar 39 by another fixing method. For example, the second fixed touch piece 38 may be connected to the second bus bar 39 by screws. Alternatively, the second fixed touch piece 38 may be formed integrally with the second bus bar 39.

The second fixed touch piece 38 includes the second contact support 31 described above. The second bus bar 39 includes the second extension 33 and the second external connection 34. The second intermediate portion 32 includes a first attachment portion 32*a* included in the second fixed touch piece 38 and a second attachment portion 32*b* included in the second bus bar 39. The first attachment portion 32*a* is formed integrally with the second contact support 31 in the second fixed touch piece 38. The second attachment portion 32*b* is formed integrally with the second extension 33 in the second bus bar 39. However, the first attachment portion 32*a* may be separate from the second contact support 31. The second attachment portion 32*b* may be separate from the second extension 33. The first attachment portion 32*a* and the second attachment portion 32*b* are disposed so as to be exposed to the outside of the case 2.

The first attachment portion 32*a* has a shape bent toward the second bus bar 39. The first attachment portion 32*a* is connected to the second attachment portion 32*b*. The second attachment portion 32*b* has a shape bent from the first attachment portion 32*a* toward the second extension 33. For example, the first attachment portion 32*a* is connected to the second attachment portion 32*b* by welding. However, the first attachment portion 32*a* may be connected to the second attachment portion 32*b* by another fixing method. For example, the first attachment portion 32*a* may be connected to the second attachment portion 32*b* by screws.

Figure 5:
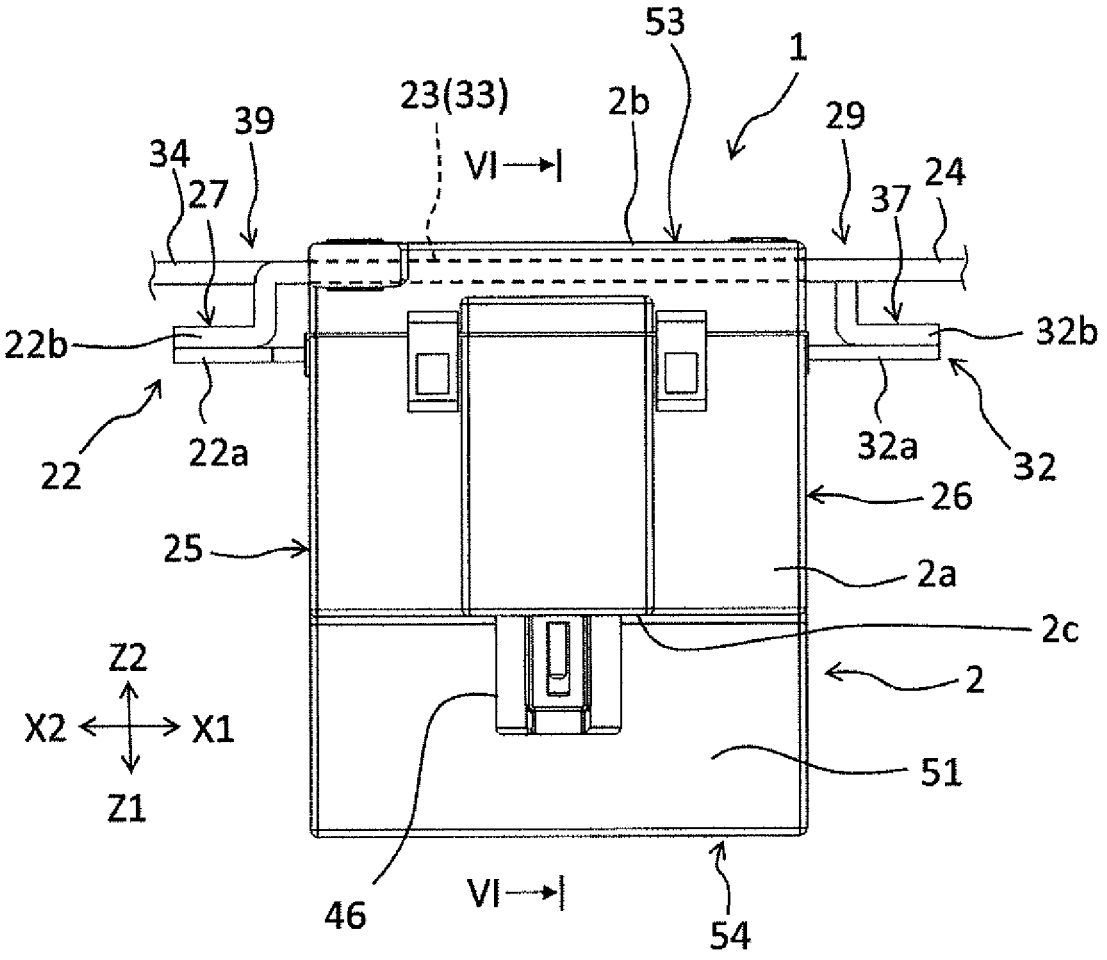
FIG. 5 is a front view of the relay.
Figure 6:
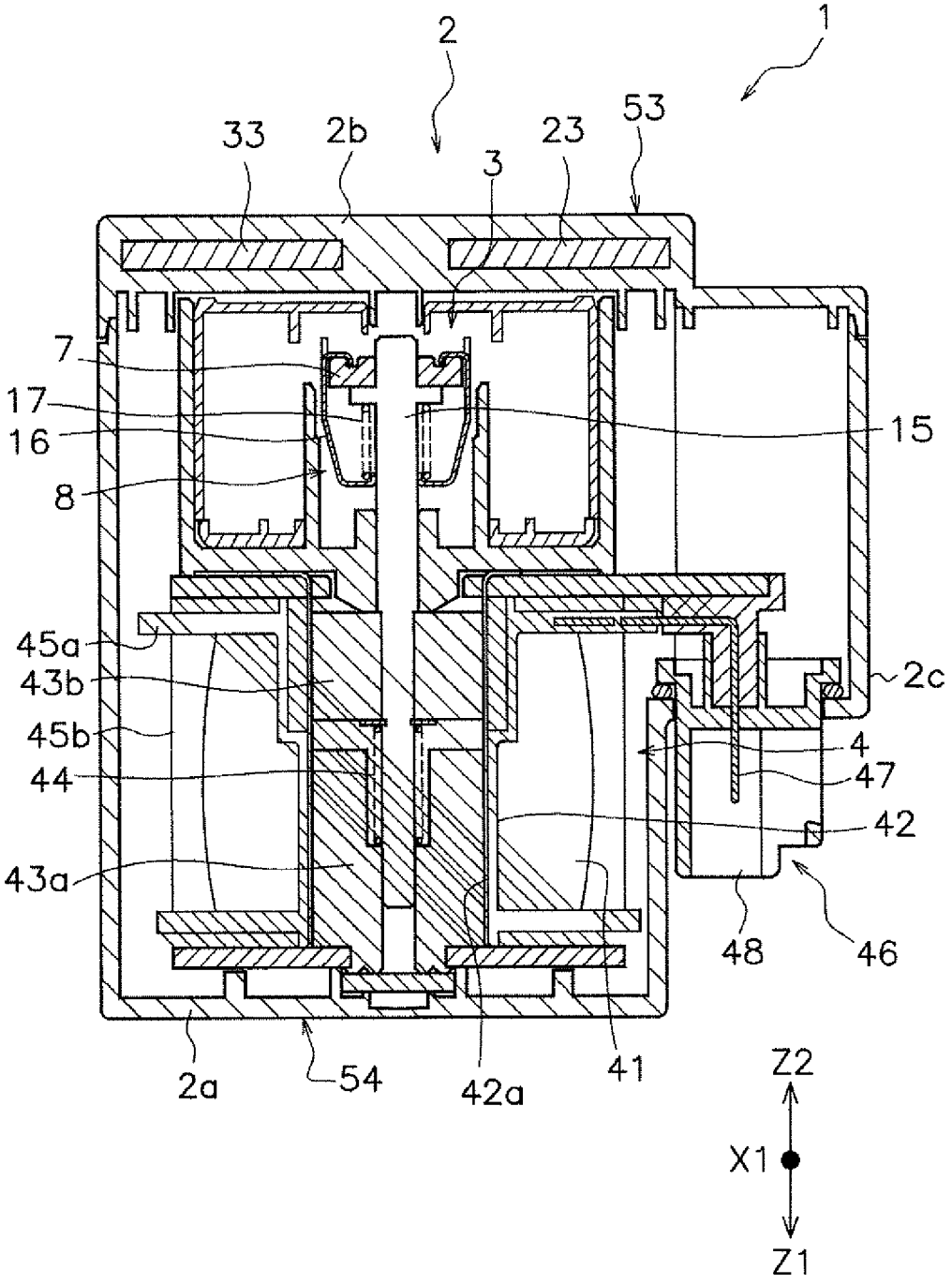
FIG. 6 is a sectional view taken along line VI-VI in FIG. 5.

FIG. 6 is a sectional view taken along a line VI-VI in FIG. 5. As illustrated in FIG. 6, the first extension 23 and the second extension 33 are embedded in the case 2. Specifically, the first extension 23 and the second extension 33 are embedded in the lid portion 2*b*.

Next, the drive device 4 will be described. The drive device 4 generates a driving force for operating the movable touch piece 7. The drive device 4 operates the movable touch piece 7 by an electromagnetic force. The drive device 4 is disposed in the movement direction (Z1, Z2) of the movable touch piece 7 with respect to the movable touch piece 7. The drive device 4 includes a coil 41, a spool 42, a core 43, a return spring 44, and a yoke 45.

The coil 41 is wound around the spool 42. The coil 41 and the spool 42 are disposed coaxially with the drive shaft 15. The spool 42 includes a hole 42*a* penetrating in an axial direction of the spool 42. The iron core 43 and the return spring 44 are inserted into a hole 42*a* of the spool 42. The iron core 43 includes a fixed iron core 43*a* and a movable iron core 43*b*. The fixed iron core 43*a* is fixed to a second yoke 45*b*, the spool 42, or the case 2. The yoke 45 is connected to the iron core 43.

The yoke 45 includes a first yoke 45*a* and a second yoke 45*b*. The first yoke 45*a* is disposed between the contact device 3 and the spool 42. The second yoke 45*b* is connected to the first yoke 45*a*. The second yoke 45*b* has a U-shape. The second yoke 45*b* is disposed on each side of the coil 41 and on the side opposite to the first yoke 45*a* with respect to the coil 41. The first yoke 45*a* is connected to one end of the iron core 43. The second yoke 45*b* is connected to the other end of the iron core 43.

The iron core 43 includes a fixed iron core 43*a* and a movable iron core 43*b*. The fixed iron core 43*a* is fixed to the second yoke 45*b*. The movable iron core 43*b* is separate from the fixed iron core 43*a*. The movable iron core 43*b* is disposed movably in the contact direction (Z1) and the separation direction (Z2). The movable iron core 43*b* is connected to the drive shaft 15. The return spring 44 is disposed between the movable iron core 43*b* and the fixed iron core 43*a*. The return spring 44 urges the movable iron core 43*b* in the separation direction (Z2).

As illustrated in FIG. 6, the relay 1 includes a coil connection 46. Hereinafter, the coil connection 46 will be described. In the following description, the direction from the contact device 3 to the drive device 4 in the movement direction (Z1, Z2) of the movable touch piece 7 is referred to as "upward", and the opposite direction is referred to as "downward." In the present embodiment, "upward" corresponds to the contact direction Z1, and "downward" corresponds to the separation direction Z2. However, the terms indicating these directions are used for convenience of description, and do not limit the attachment direction of the relay 1, or the like.

The coil connection 46 includes a coil terminal 47 and a connector 48. The coil terminal 47 is connected to the coil 41. The connector 48 supports the coil terminal 47. The connector 48 has a socket shape covering the coil terminal 47. However, the connector 48 is not limited to a socket shape and may have another shape. For example, the connector 48 may have a structure including a terminal block supporting the coil terminal 47 and a screw for connecting the electric wire to the coil terminal 47.

The coil connection 46 is provided on the outer surface of the case 2. Specifically, as illustrated in FIGS. 1 to 5, the case 2 includes a third outer side surface 51, a fourth outer side surface 52, a bottom surface 53, and a top surface 54. The third outer side surface 51 and the fourth outer side surface 52 are disposed at intervals in the lateral direction of the movable touch piece 7. The third outer side surface 51 and the fourth outer side surface 52 extend in the movement direction (Z1, Z2) of the movable touch piece 7. The third outer side surface 51 and the fourth outer side surface 52 are disposed along the first direction (X1) and the second direction (X2).

The bottom surface 53 and the top surface 54 are disposed as spaced from each other in the movement direction (Z1, Z2) of the movable touch piece 7. The bottom surface 53 and the top surface 54 extend in the lateral direction of the movable touch piece 7. The bottom surface 53 and the top surface 54 extend in the longitudinal direction (X1, X2) of the movable touch piece 7. The top surface 54 is disposed above the drive device 4. The bottom surface 53 is disposed below the contact device 3. The contact device 3 is disposed closer to the bottom surface 53 than to the top surface 54. The bottom surface 53 is disposed close to the first bus bar 29. The bottom surface 53 is parallel to the first bus bar 29. The drive device 4 is disposed closer to the top surface 54 than to the bottom surface 53.

As illustrated in FIGS. 1 and 2, the coil connection 46 is provided so as to face the third outer side surface 51 of the case 2. The coil connection 46 is disposed in a position not overlapping with the top surface 54 as viewed in the movement direction (Z1, Z2) of the movable touch piece 7. The case 2 includes a step 2*c* protruding from the third outer side surface 51. The connector 48 extends upward from the step 2*c* and opens upward. That is, the connector 48 is disposed facing upward. The connector 48 is disposed facing a direction away from the first bus bar 29.

Figure 7:
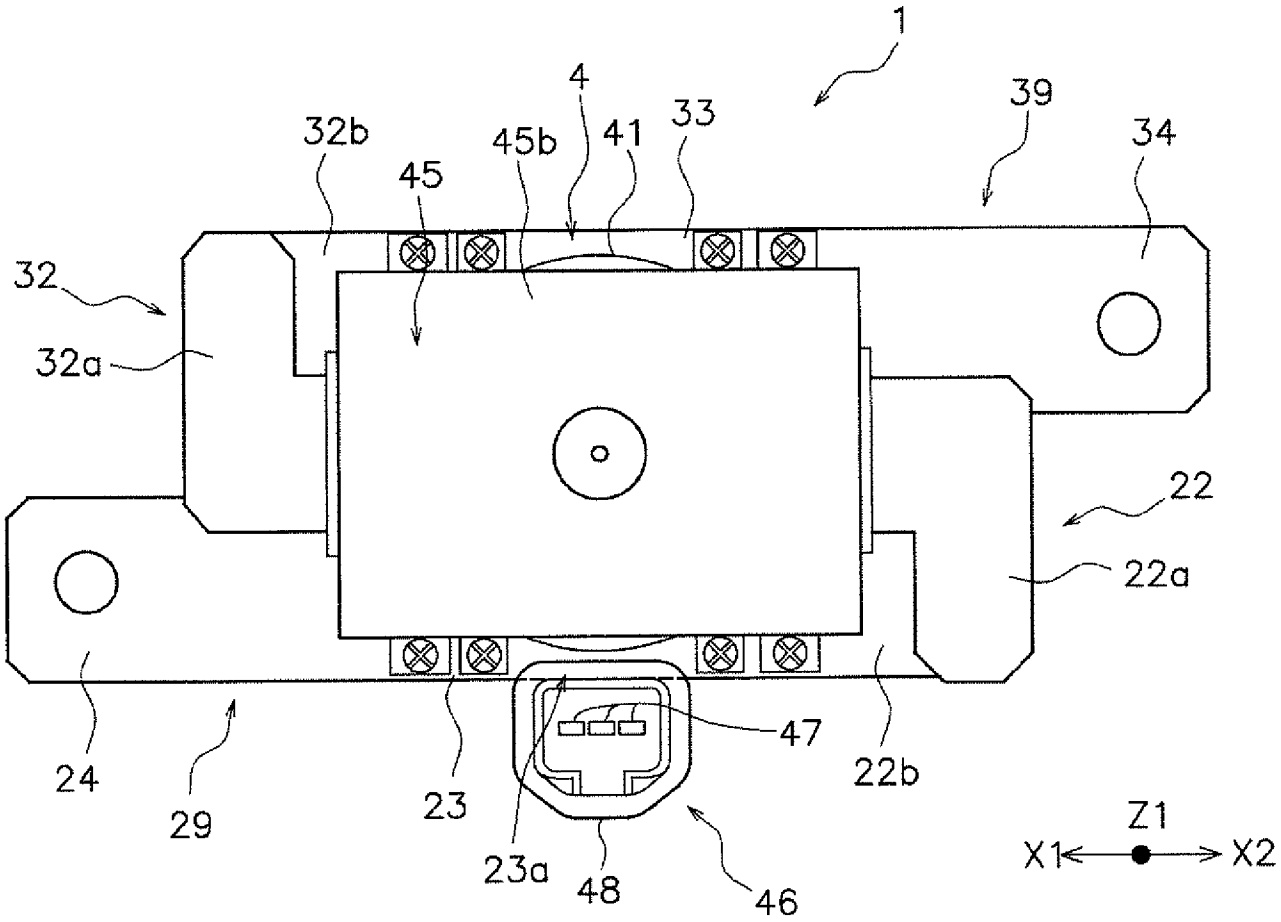
FIG. 7 is a plan view illustrating placement of a coil connection.

FIG. 7 is a plan view illustrating placement of the coil connection 46. In FIG. 7, the case 2 is omitted. As illustrated in FIG. 7, the first bus bar 29 includes a portion not overlapping with the drive device 4 as viewed in the movement direction (Z1, Z2) of the movable touch piece 7. Specifically, the first bus bar 29 includes a portion not overlapping with the yoke 45 as viewed in the movement direction (Z1, Z2) of the movable touch piece 7.

At least a part of the coil connection 46 is disposed so as to overlap with a portion of the first bus bar 29 which does not overlap with the yoke 45 as viewed in the movement direction (Z1, Z2) of the movable touch piece 7. Particularly, a part of the first extension 23 includes a portion 23*a* protruding from the yoke 45 in the lateral direction of the movable touch piece as viewed in the movement direction (Z1, Z2) of the movable touch piece 7. A part of the connector 48 is disposed so as to overlap the portion 23*a* protruding from the yoke 45 in the first extension 23 as viewed in the movement direction (Z1, Z2) of the movable touch piece 7.

Next, the operation of the relay 1 will be described. When no voltage is applied to the coil 41, the drive shaft 15 is pressed, together with the movable iron core 43*b*, in the separation direction (Z2) by an elastic force of the return spring 44. Therefore, the movable touch piece 7 is also pressed in the separation direction (Z2), and the first movable contact 13 and the second movable contact 14 are in an open state, being separated from the first fixed contact 11 and the second fixed contact 12.

When a voltage is applied to the coil 41 and excited, the movable iron core 43*b* moves in the contact direction (Z1) against the elastic force of the return spring 44. Thus, by movement of the drive shaft 15 and the movable touch piece 7 in the contact direction (Z1), the first movable contact 13 and the second movable contact 14 are brought into a closed state, being in contact with the first fixed contact 11 and the second fixed contact 12. In this closed state, a current flows from the first fixed terminal 5 to the second fixed terminal 6 through the movable touch piece 7.

Figure 8:
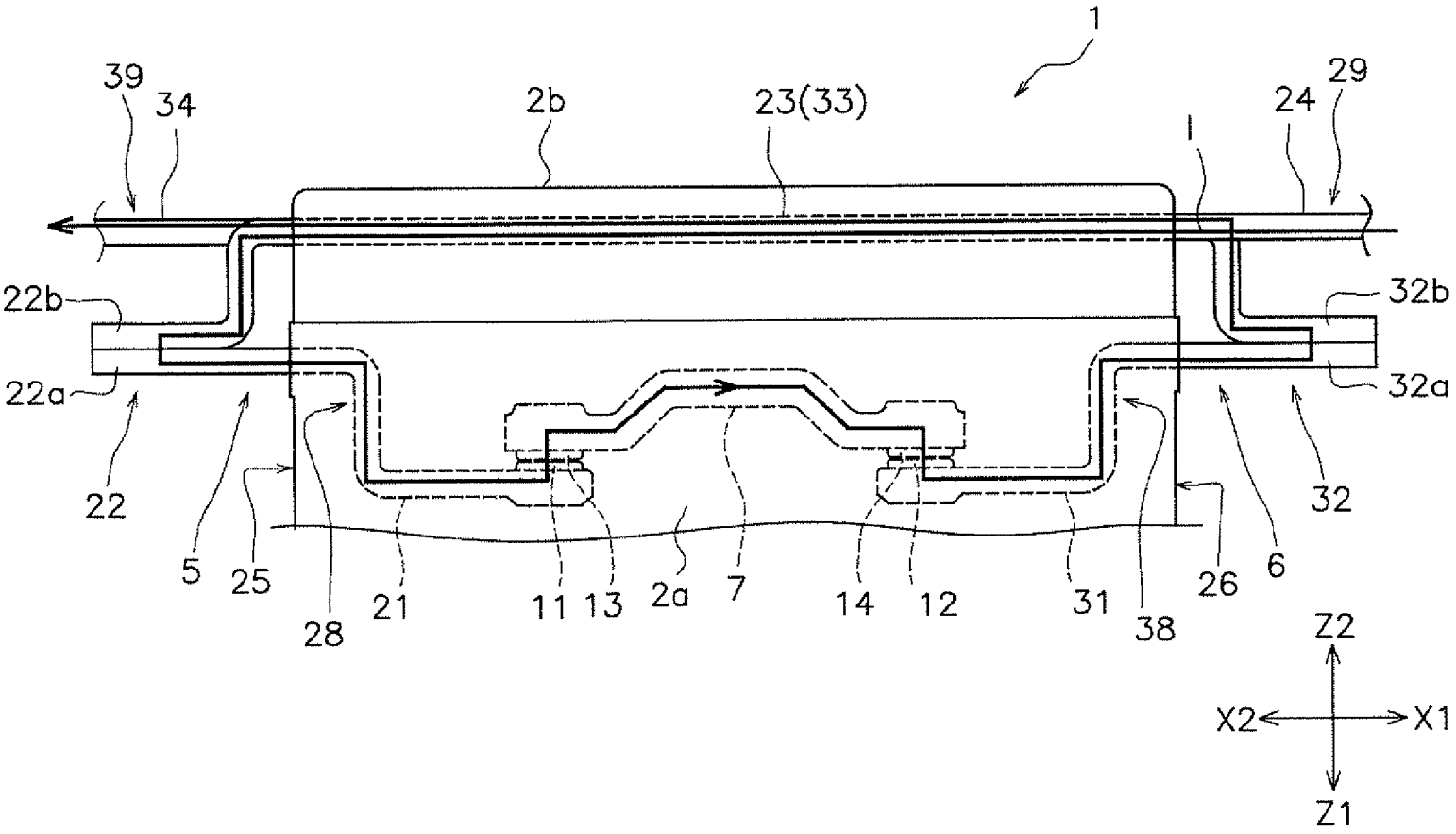
FIG. 8 is a schematic diagram illustrating a current flow in the relay in a closed state.

FIG. 8 is a diagram illustrating the flow of the current I in the closed state. As illustrated in FIG. 8, the current I flows from the first external connection 24 to the movable touch piece 7 through the first extension 23, the first intermediate portion 22, the first contact support 21, the first fixed contact 11, and the first movable contact 13. The current I passes from the movable touch piece 7 through the second movable contact 14, the second fixed contact 12, the second contact support 31, the second intermediate portion 32, and the second extension 33, and the second external connection 34.

In the relay 1 according to the present embodiment, the first extension 23 extends in a first direction (X1) from the first movable contact 13 to the second movable contact 14, and the first external connection 24 connected to the first extension 23 protrudes in the first direction (X1) from the case 2. The current I flows in the first extension 23 in a direction opposite to that of the movable touch piece 7. Hence in the first fixed terminal 5, it is possible to ensure a large section in which the current I flows in the opposite direction to the movable touch piece 7. This enables an increase in electromagnetic repulsive force acting on the movable touch piece 7.

Further, the second extension 33 extends in the second direction (X2) from the second movable contact 14 to the first movable contact 13, and the second external connection 34 connected to the second extension 33 protrudes in the second direction (X2) from the case 2. A current I flows in the second extension 33 in a direction opposite to that of the movable touch piece 7. Therefore, in the second fixed terminal 6, it is possible to ensure a large section in which the current I flows in the opposite direction to the movable touch piece 7. Thereby, the electromagnetic repulsive force acting on the movable touch piece 7 can be further increased.

As described above, in the relay according to the present embodiment, a current flows in the first extension 23 and the second extension 33 in a direction opposite to that of the movable touch piece 7, thereby increasing the electromagnetic repulsive force acting on the movable touch piece 7. This can increase the contact pressure between the first movable contact 13 and the first fixed contact 11 and the contact pressure between the second movable contact 14 and the second fixed contact 12.

In the relay 1 according to the present embodiment, at least a part of the coil connection 46 has a portion 23*a* not overlapping with the yoke 45 in the first extension 23 as viewed in the movement direction (Z1, Z2) of the movable touch piece 7. It is thus possible to dispose the coil connection 46 in a space which becomes a dead space in the relay 1. This can prevent an increase in size of the relay 1.

The connector 48 is disposed facing a direction away from the first bus bar 29. This can facilitate connecting to the connector 48 when the relay 1 is installed with the first bus bar 29 facing downward.

The coil connection 46 is disposed so as to face the third outer side surface 51. Therefore, as compared with a configuration where the coil connection 46 is provided on the top surface 54 or the bottom surface 53 of the case 2, the size of the relay 1 can be reduced in the movement direction (Z1, Z2) of the movable touch piece 7.

Although embodiments of the present invention are described above, the present invention is not limited to the above embodiments, and various changes can be made in the scope not deviating from the gist of the present invention. For example, the configuration of the drive device 4 may be changed. The shape or placement of the coil 41, the spool 42, the iron core 43, the return spring 44, or the yoke 45 may be changed. The shape or placement of the case 2 may be changed.

In the above embodiment, by the drive device 4 drawing the drive shaft 15 toward the coil 41 side, the movable touch piece 7 moves in the contact direction (Z1). By the drive device 4 pushing the drive shaft 15 from the coil 41 side, the movable touch piece 7 moves in the separation direction (Z2). However, by the drive device 4 drawing the drive shaft 15 toward the coil 41 side, the movable touch piece 7 may move in the separation direction (Z2). By the drive device 4 pushing the drive shaft 15 from the coil 41 side, the movable touch piece 7 may move in the contact direction (Z1). In this case, the above "upward" may correspond to the separation direction Z2, and the above "downward" may correspond to the contact direction Z1.

The shape or placement of the first fixed terminal 5, the second fixed terminal 6, and the movable touch piece 7 may be changed. For example, the placement of the first fixed terminal 5 and the second fixed terminal 6 is not limited to that of the embodiment described above, and may be interchanged.

Figure 9:
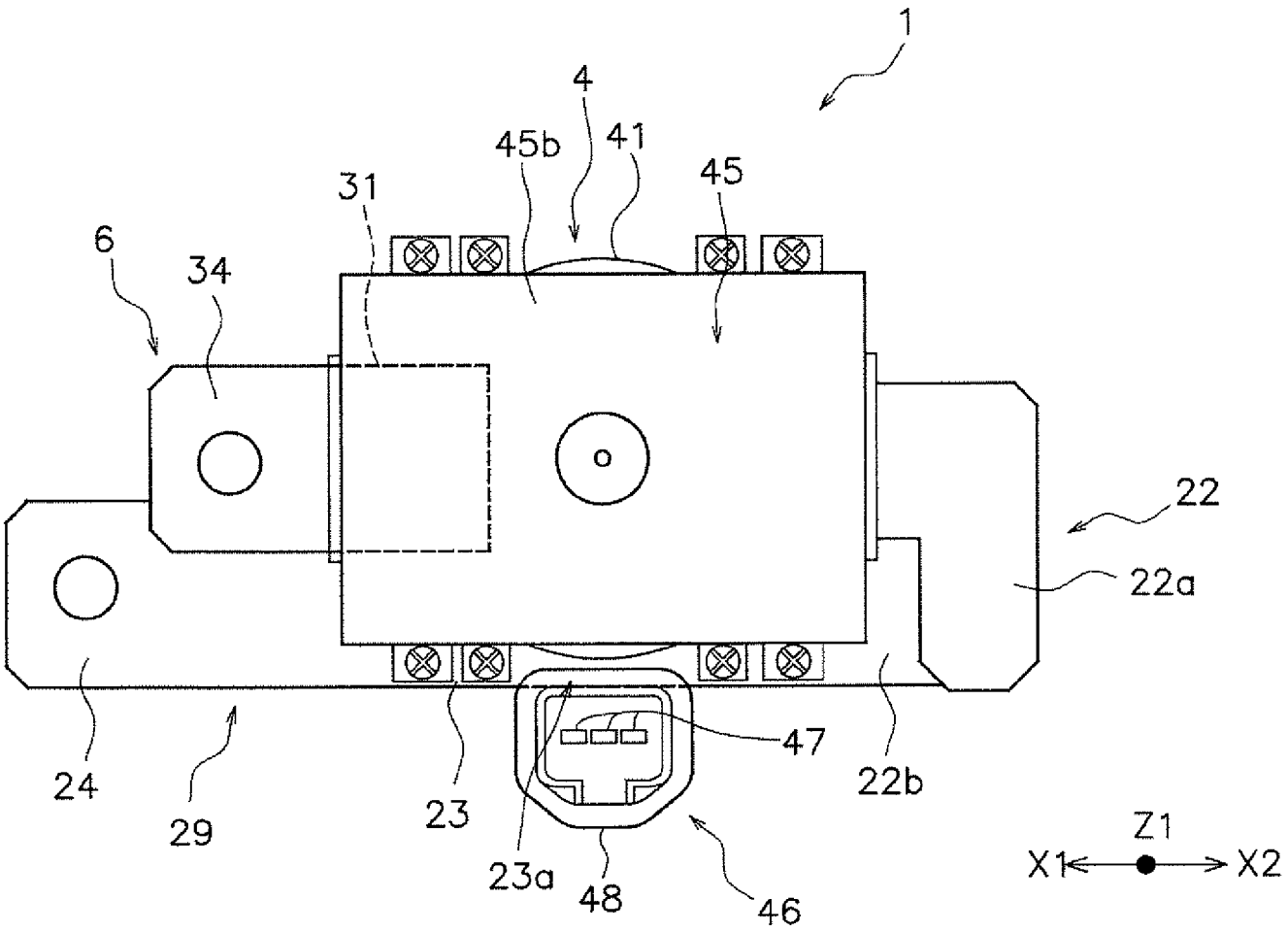
FIG. 9 is a plan view illustrating placement of the coil connection according to a first modified example.

In the above embodiment, the first extension 23 and the second extension 33 are provided. However, the second extension 33 may be omitted. FIG. 9 is a diagram illustrating the relay 1 according to a first modified example. As illustrated in FIG. 9, in the second fixed terminal 6, the second extension 33 and the second intermediate portion 32 may be omitted. The second fixed terminal 6 may be constituted by the second contact support 31 and the second external connection 34.

Figure 10:
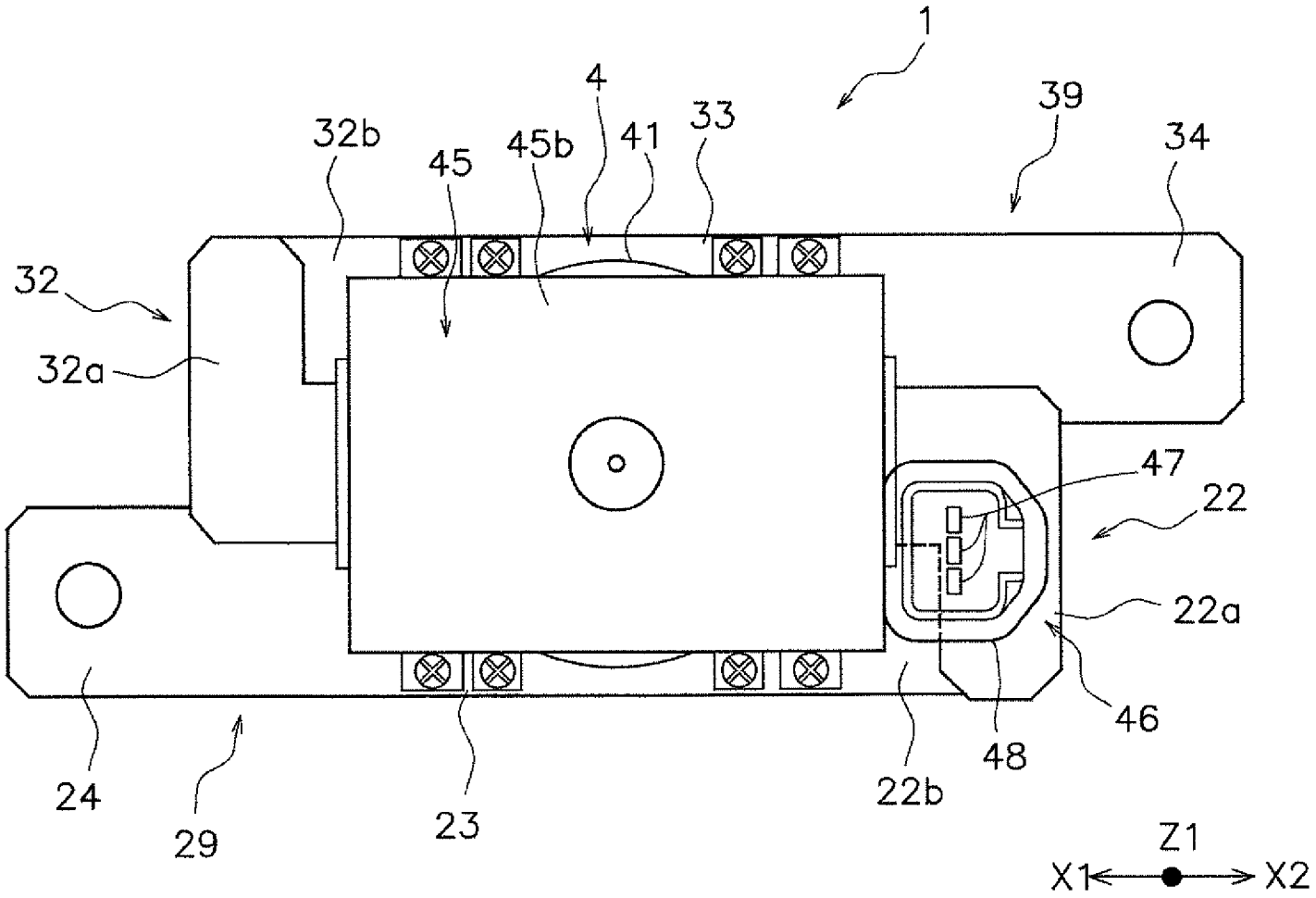
FIG. 10 is a plan view illustrating placement of the coil connection according to a second modified example.

The position of the coil connection 46 may be changed. FIG. 10 is a plan view illustrating the relay 1 according to a second modified example. As illustrated in FIG. 10, at least a part of the coil connection 46 may be disposed in a position overlapping with the first intermediate portion 22 as viewed in the movement direction (Z1, Z2) of the movable touch piece 7. In this instance, the coil connection 46 may be disposed so as to face the first outer side surface 25 of the case 2.

Figure 11:
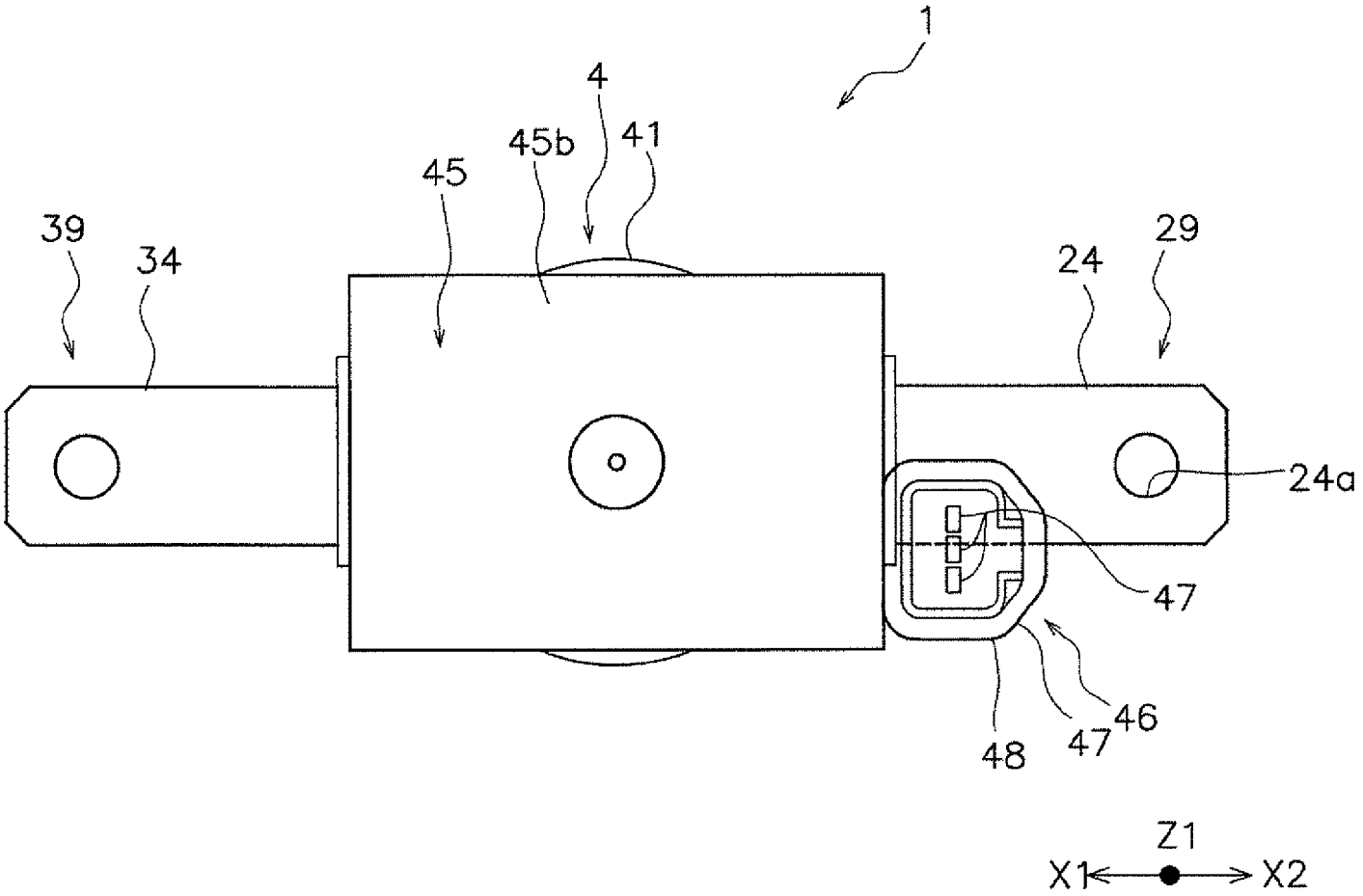
FIG. 11 is a plan view illustrating placement of coil connection according to a third modified example.

FIG. 11 is a plan view illustrating the relay 1 according to a third modified example. As illustrated in FIG. 11, at least a part of the coil connection 46 may be disposed in a position overlapping with the first external connection 24 as viewed in the movement direction (Z1, Z2) of the movable touch piece 7. In this instance, the coil connection 46 may be disposed facing the first outer side surface 25 of the case. In a third modified example, the first extension 23 described above is omitted in the first fixed terminal 5, and the second extension 33 is omitted in the second fixed terminal 6.

The first external connection 24 includes a connection structure 24*a* connected to an external circuit. In the present embodiment, the connection structure 24*a* is a hole provided in the first external connection 24. However, the connection structure 24*a* may be another structure such as a screw or a tab. The coil connection 46 may be disposed in a position not overlapping with the connection structure 24*a* as viewed in the movement direction (Z1, Z2) of the movable touch piece 7.

Figure 12:
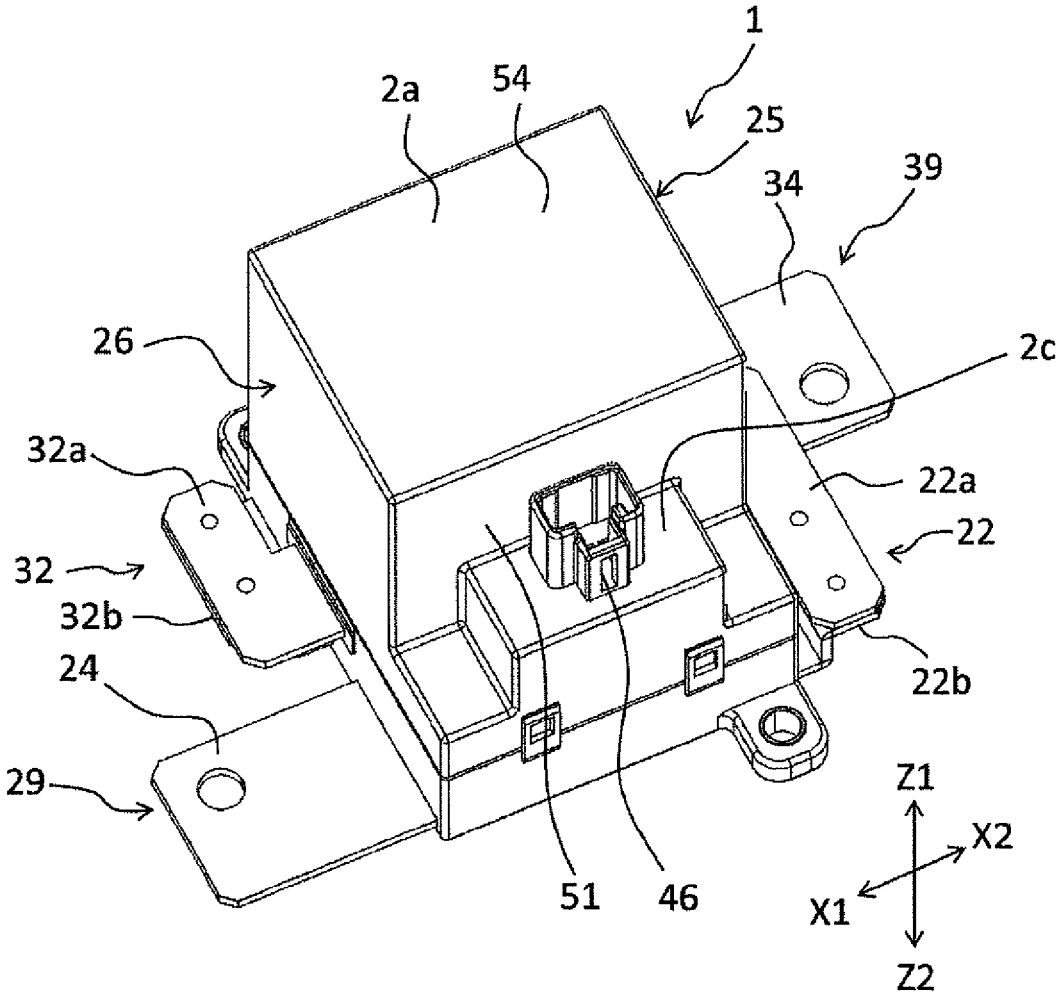
FIG. 12 is a perspective view of a relay according to a fourth modified example.
Figure 13:
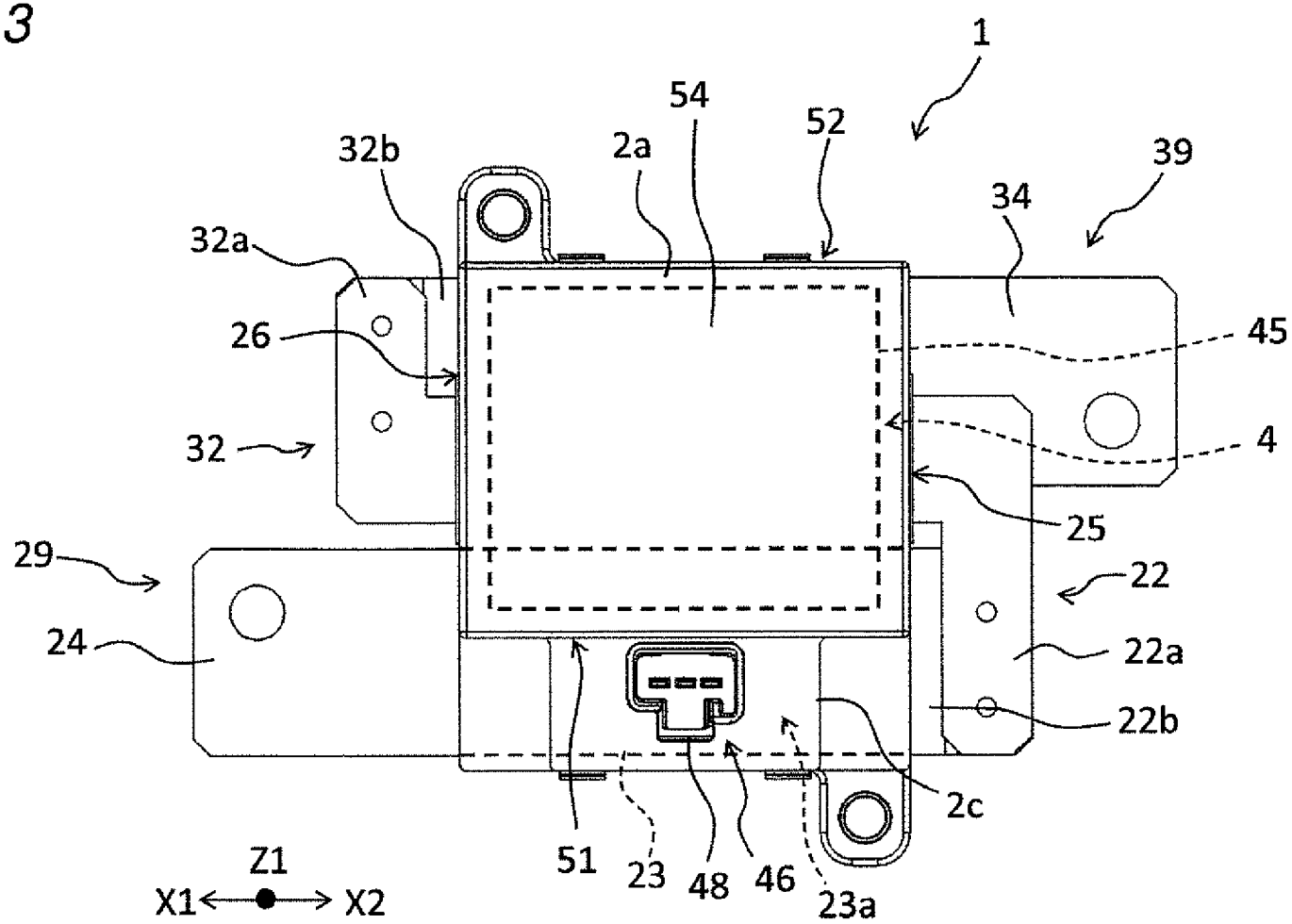
FIG. 13 is a plan view of the relay according to the fourth modified example.

FIG. 12 is a perspective view of the relay 1 according to a fourth modified example. FIG. 13 is a plan view of the relay 1 according to the fourth modified example. As illustrated in FIGS. 12 and 13, the whole of the coil connection 46 overlaps with a portion of the first extension 23 not overlapping with the drive device 4 as viewed in the movement direction (Z1, Z2) of the movable touch piece 7. The whole of the coil connection 46 may be disposed so as to overlap with the portion 23*a* not overlapping with the yoke 45 in the first extension 23 as viewed in the movement direction (Z1, Z2) of the movable touch piece 7.

Figure 14:
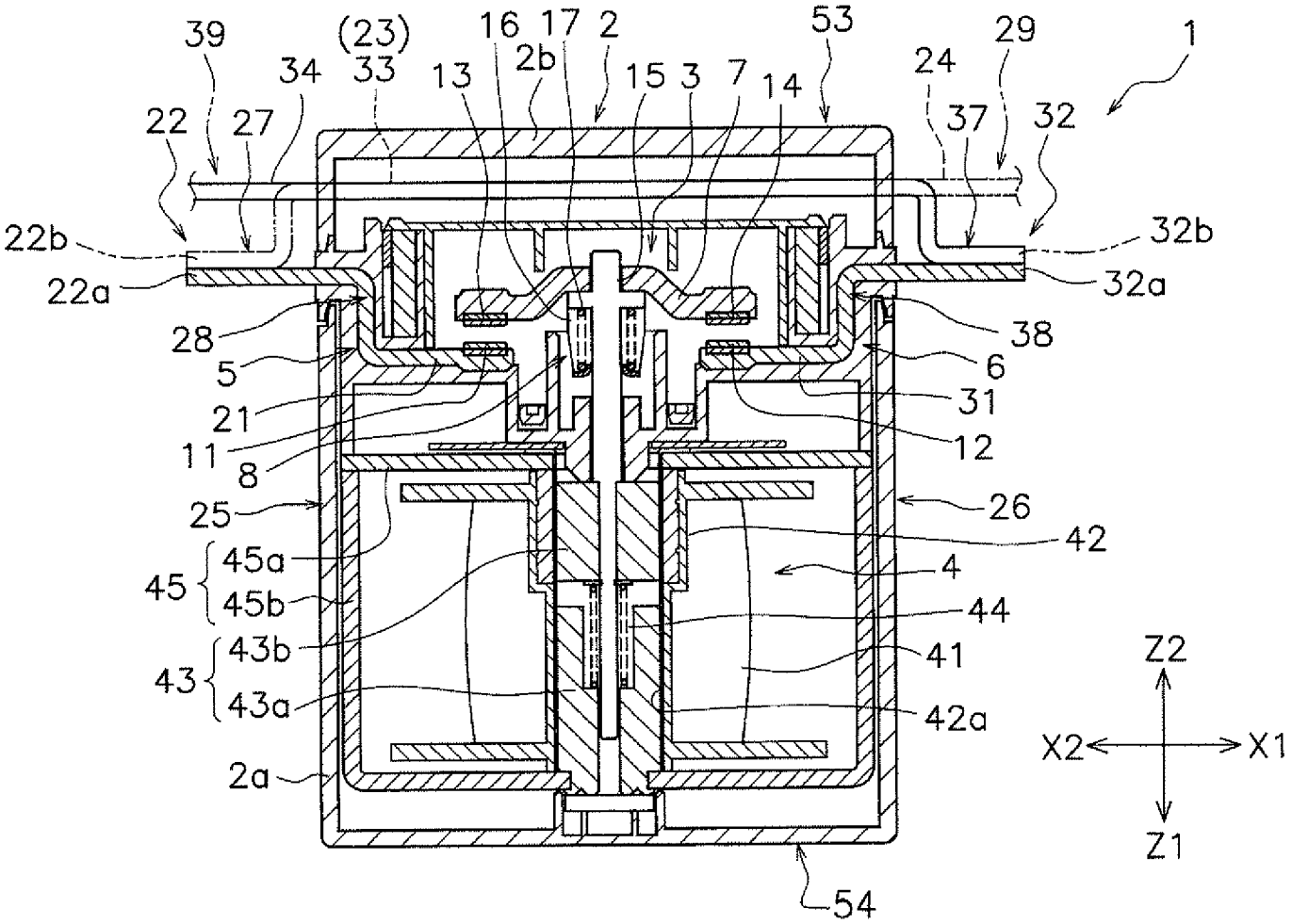
FIG. 14 is a sectional view of a relay according to a fifth modified example.
Figure 15:
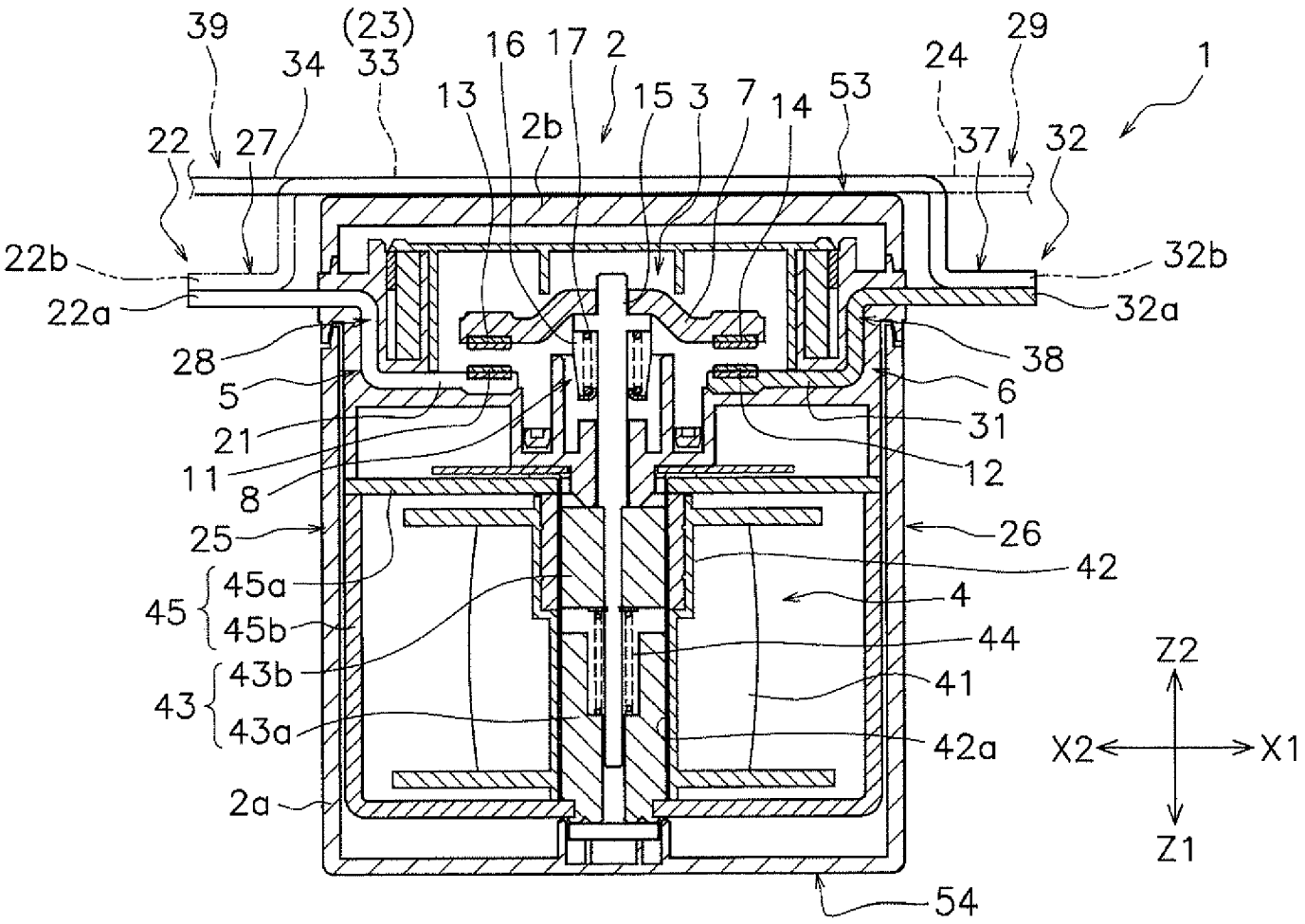
FIG. 15 is a sectional view of a relay according to a sixth modified example.

In the above embodiment, the first extension 23 and the second extension 33 are embedded in the lid portion 2*b* of the case 2. However, the first extension 23 and the second extension 33 may be embedded in other portions of the case 2. Alternatively, FIG. 14 is a sectional view of the relay 1 according to a fifth modified example. As illustrated in FIG. 14, the first extension 23 and the second extension 33 may be disposed in the accommodation space inside the case 2. Alternatively, FIG. 15 is a sectional view of the relay 1 according to a sixth modified example. As illustrated in FIG. 15, the first extension 23 and the second extension 33 may be disposed outside the case 2.

According to one or more embodiments of the present invention, it is possible to prevent an increase in relay size in a relay in which the coil connection is provided on the outer surface of the case.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A relay comprising:

a case;

a first fixed terminal including a first fixed contact;

a second fixed terminal including a second fixed contact;

a movable touch piece including a first movable contact that is disposed facing the first fixed contact and a second movable contact that is disposed facing the second fixed contact, the movable touch piece being disposed in the case and disposed so as to be movable in a direction in which the first movable contact and the second movable contact come into contact with the first fixed contact and the second fixed contact and in a direction in which the first movable contact and the second movable contact separate from the first fixed contact and the second fixed contact;

a drive shaft connected to the movable touch piece and extending in a movement direction of the movable touch piece;

a coil configured to generate a driving force for operating the drive shaft;

a drive device including an iron core inserted in the coil, and a yoke connected to the iron core, the drive device being disposed in the movement direction of the movable touch piece with respect to the movable touch piece; and a coil connection including a coil terminal connected to the coil, and a connector configured to support the coil terminal, the coil connection being provided on an outer surface of the case, wherein the first fixed terminal includes:

a first fixed touch piece configured to support the first fixed contact, and a first bus bar connected to the first fixed touch piece, and at least a part of which is disposed outside the case, wherein the first bus bar includes a portion not overlapping with the drive device as viewed in the movement direction of the movable touch piece, and wherein at least a part of the coil connection is disposed so as to overlap with a portion of the first bus bar not overlapping with the drive device as viewed in the movement direction of the movable touch piece.

2. The relay according to claim 1, wherein the first bus bar includes a first extension extending in a first direction from the first movable contact to the second movable contact, and wherein at least a part of the coil connection is disposed in a position overlapping with the first extension as viewed in the movement direction of the movable touch piece.

3. The relay according to claim 2, wherein the connector is disposed facing a direction away from the first bus bar.

4. The relay according to claim 2, wherein the case includes a side surface extending along the movement direction of the movable touch piece, and wherein the coil connection is disposed facing the side surface.

5. The relay according to claim 2, wherein the case includes a top surface disposed in the movement direction of the movable touch piece with respect to the drive device, and wherein the coil connection is disposed in a position not overlapping with the top surface as viewed in the movement direction of the movable touch piece.

6. The relay according to claim 1, wherein the first fixed terminal includes:

a first contact support included in the first fixed touch piece and disposed in the case, a first extension included in the first bus bar and extending in a first direction from the first movable contact to the second movable contact, and a first intermediate portion having a shape folded back from the first contact support toward the first extension, and wherein at least a part of the coil connection is disposed in a position overlapping with the first intermediate portion as viewed in the movement direction of the movable touch piece.

7. The relay according to claim 6, wherein the connector is disposed facing a direction away from the first bus bar.

8. The relay according to claim 6, wherein the case includes a side surface extending along the movement direction of the movable touch piece, and wherein the coil connection is disposed facing the side surface.

9. The relay according to claim 1, wherein the first bus bar includes a first external connection disposed outside the case, and wherein at least a part of the coil connection is disposed in a position overlapping with the first external connection as viewed in the movement direction of the movable touch piece.

10. The relay according to claim 9, wherein the first external connection includes a connection structure connected to an external circuit, and wherein the coil connection is disposed in a position not overlapping with the connection structure as viewed in the movement direction of the movable touch piece.

11. The relay according to claim 10, wherein the connector is disposed facing a direction away from the first bus bar.

12. The relay according to claim 10, wherein the case includes a side surface extending along the movement direction of the movable touch piece, and wherein the coil connection is disposed facing the side surface.

13. The relay according to claim 9, wherein the connector is disposed facing a direction away from the first bus bar.

14. The relay according to claim 9, wherein the case includes a side surface extending along the movement direction of the movable touch piece, and wherein the coil connection is disposed facing the side surface.

15. The relay according to claim 1, wherein the connector is disposed facing a direction away from the first bus bar.

16. The relay according to claim 15, wherein the case includes a side surface extending along the movement direction of the movable touch piece, and wherein the coil connection is disposed facing the side surface.

17. The relay according to claim 1, wherein the case includes a side surface extending along the movement direction of the movable touch piece, and wherein the coil connection is disposed facing the side surface.

18. The relay according to claim 1, wherein the case includes a top surface disposed in the movement direction of the movable touch piece with respect to the drive device, and wherein the coil connection is disposed in a position not overlapping with the top surface as viewed in the movement direction of the movable touch piece.

19. The relay according to claim 1, wherein the first bus bar has a flat plate shape, and wherein the first bus bar is disposed such that a normal direction of the first bus bar faces the movement direction of the movable touch piece.

20. The relay according to claim 1, wherein the first bus bar includes a portion not overlapping with the yoke as viewed in the movement direction of the movable touch piece, and wherein at least a part of the coil connection is disposed so as to overlap with a portion of the first bus bar not overlapping with the yoke as viewed in the movement direction of the movable touch piece.

* * * * *